US005430467A

United States Patent [19]

Yamaguchi et al.

[11] Patent Number: 5,430,467

[45] Date of Patent: Jul. 4, 1995

[54] THERMAL RECORDING SYSTEM

[75] Inventors: Takashi Yamaguchi; Tadayoshi Ohno; Shinichi Itoh, all of Kanagawa, Japan

[73] Assignee: Kabushiki Kaisha Toshiba, Kawasaki, Japan

[21] Appl. No.: 904,658

[22] Filed: Jun. 26, 1992

[30] Foreign Application Priority Data

Jun. 27, 1991 [JP] Japan ..... 3-156945

[51] Int. Cl.[6] ..... B41J 2/32; B41M 5/26

[52] U.S. Cl. ..... 347/171; 346/135.1; 347/224

[58] Field of Search ..... 430/293; 346/76 PH, 346/76 R, 135.1, 1.1

[56] References Cited

U.S. PATENT DOCUMENTS 4,695,528 9/1987 Dabisch et al. ..... 430/290

5,235,345 8/1993 Ohno et al. ..... 346/76 PH

FOREIGN PATENT DOCUMENTS 61-15469 1/1986 Japan .

*Primary Examiner*—Huan H. Tran

*Attorney, Agent, or Firm*—Cushman, Darby & Cushman

[57] ABSTRACT

A thermal recording system having a plurality of thermal elements, accurately records and erases images on a recording medium. The images are recorded on or erased from the recording medium by selectively supplying the recording energy or erasing energy to the thermal elements. The system calculates a dot ratio concerning the proportion of the total value of mark dots and space dots to the number of total dots, in a reference area on the recording medium. Moreover, the system has a plurality of weighting tables in accordance with the dot ratio, the weighting tables include correction value respectively. The system selects one of the weighting tables and control the recording energy and the erasing energy to be supplied to the thermal elements, with reference to the correction value of the selected weighting table.

2 Claims, 5 Drawing Sheets

Fig. 4(a)
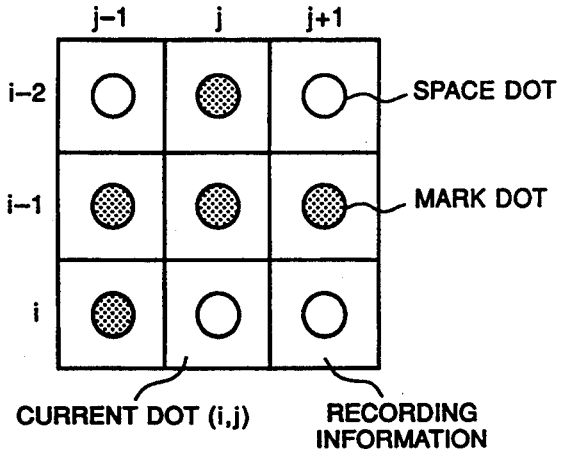
Fig. 4(b)
| | | |
|---|---|---|
| M: -0.2 S: -0.0 | M: -0.4 S: -0.0 | M: -0.2 S: -0.0 |
| M: -0.3 S: -0.0 | M: -0.5 S: -0.1 | M: -0.3 S: -0.0 |
| M: -0.4 S: -0.0 | M: 8 S: 5 | M: -0.4 S: -0.0 |
Fig. 4(c)
| | | |
|---|---|---|
| M: -0.3 S: -0.0 | M: -0.5 S: -0.1 | M: -0.3 S: -0.0 |
| M: -0.4 S: -0.0 | M: -0.6 S: -0.2 | M: -0.4 S: -0.0 |
| M: -0.5 S: -0.1 | M: 8 S: 5 | M: -0.5 S: -0.1 |
Fig. 4(d)
| | | |
|---|---|---|
| M: -0.4 S: -0.0 | M: -0.6 S: -0.2 | M: -0.4 S: -0.0 |
| M: -0.5 S: -0.1 | M: -0.7 S: -0.3 | M: -0.5 S: -0.1 |
| M: -0.6 S: -0.2 | M: 8 S: 5 | M: -0.6 S: -0.2 |
Fig. 4(e)
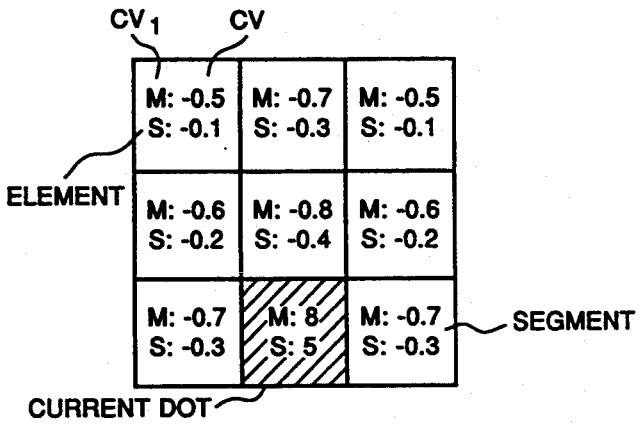
Fig. 4(f)
| | | |
|---|---|---|
| M: -0.6 S: -0.2 | M: -0.8 S: -0.4 | M: -0.6 S: -0.2 |
| M: -0.7 S: -0.3 | M: -0.9 S: -0.5 | M: -0.7 S: -0.3 |
| M: -0.8 S: -0.4 | M: 8 S: 5 | M: -0.8 S: -0.4 |

THERMAL RECORDING SYSTEM

BACKGROUND OF THE INVENTION

1. Field of the Invention

The present invention relates to a thermal recording system, and more particularly to a thermal recording system for electrically controlling the temperature of thermal elements.

2. Description of the Related Art

Thermal printers are widely used in devices such as computer systems, ticket vending machines and automatic fare systems. In particular, the thermal printer prints alphanumeric characters in dot matrix form on a medium coated with a thermally sensitive material. The thermal elements of the thermal printer comprise thin film deposited resistors through which an electric current is passed. The electric current is supplied in the form of pulses to heat the thermally sensitive material to a temperature at which it changes from a first state to a second state, i.e., a color. Thereby, the alphanumeric characters are printed on the paper by supplying the electric current to the proper elements.

Japanese Patent Disclosure No. 61-15469 (Kokai) titled "THERMAL PRINTING SYSTEM" published Jan. 23, 1986 to Nagato discloses an energy control system for a thermal printer. The thermal printer varies the pulse width of the electric current. The pulse width of the electric current is determined based on the pattern of the presence or absence of preceding dot images, succeeding (or following) dot images and any peripheral dot images.

The U.S. Pat. No. 4,695,528 titled "PROCESS FOR FORMING IMAGE USING BODY WITH REVERSIBLE FIXABLE AND TEMPERATURE-VARIABLE LIGHT EXTINCTIONS" issued Sep. 22, 1987 to Dabisch et al. discloses a thermally sensitive material. The thermally sensitive material exhibits maximum light extinction when cooled to a temperature T0 after heated to a temperature T2. Moreover, the thermally sensitive material exhibits minimum light extinction when cooled to a temperature T0 after heated to a temperature T1 ($T0<TI<T2$).

However, the thermal printer disclosed by Nagato cannot print correctly images on the thermally sensitive material, disclosed by Dabisch et al. That is to say, when attempting to heat the thermal element to a temperature T2, an actual temperature of the thermal element might not reach temperature T2 if the environmental temperature is too cool. In this case, the thermally sensitive material would not exhibit maximum light extinction. At other times when attempting to heat the thermal elements to temperature T1, the temperature of the thermal element may reach a higher temperature T2, because the thermal elements have accumulated heat. The environmental temperature may also be too hot. Therefore, the thermally sensitive material does not exhibit minimum light extinction.

SUMMARY OF THE INVENTION

It is therefore an object of the present invention to provide a thermal recording system which, in order to solve the problems described above, can accurately heat a medium by electrically controlling the energy applied to the thermal elements.

In accordance with the present invention, the foregoing objective is achieved by providing the thermal recording system for heating the medium coated with a material which changes to a first light extinction at a first threshold temperature and changes to a second light extinction which is greater than the first light extinction at a second threshold temperature which is higher than the first threshold temperature. The system has means, having a plurality of thermal elements, for heating the medium based on an applied energy, calculating means for calculating a dot ratio concerning the proportion of the number of dots corresponding to the first light extinction to the number of dots corresponding to the second light extinction in a reference area on the medium, memory means for storing a plurality of weighting tables including a correction value which is used to correct the energy to be supplied to the thermal elements, selecting means for selecting one of the weighting tables based on the dot ratio calculated by the calculating means and control means for controlling the energy to be supplied to the thermal elements based on the correction value of the weighting table selected by the selecting means.

In accordance with another aspect of the present invention, a solution to the above-stated problem is achieved by providing a method for changing a light extinction of a material coated on the medium. The material exhibits a first light extinction at a first threshold temperature and exhibits a second light extinction at a second threshold temperature which is higher than the first threshold temperature, the method utilizing a thermal head having a plurality of thermal elements which heat the material based on an applied energy, the method having the steps of storing a plurality of weighting tables including a correction value which is used to correct the energy to be supplied to the thermal elements, calculating a dot ratio concerning a ratio of the number of dots corresponding to the second light extinction to whole number of dots in a reference area on the medium, selecting one of the weighting tables based on the dot ratio and controlling the energy applied to the thermal elements based on the correction value of the selected weighting table.

BRIEF DESCRIPTION OF THE DRAWINGS

A more complete appreciation of the invention and many of the attendant advantages thereof will be more readily obtained through reference to the following detailed description and accompanying drawings, wherein:

FIGS. 4(*a*)–4(*f*) are tables showing examples of dot patterns of recording information in the reference area of the dots and weighting tables.

DETAILED DESCRIPTION OF THE PREFERRED EMBODIMENT

Figure 1:
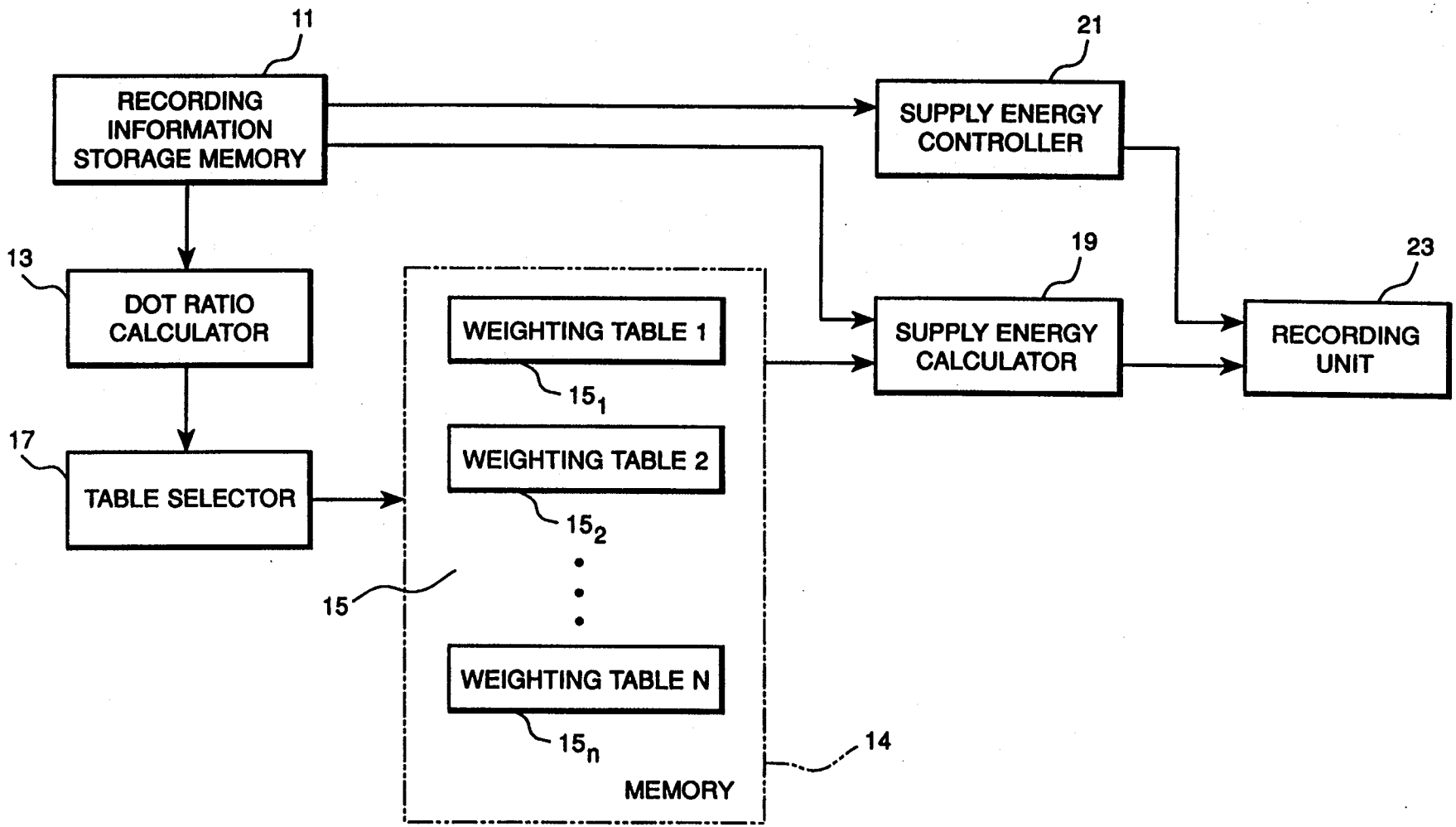
FIG. 1 is a block diagram of a thermal recording system which records images.

FIG. 1 shows a block diagram of a thermal recording system of the present invention.

In this embodiment, the thermal recording system records an image on a medium coated with a thermally sensitive material which exhibits maximum light extinction (opaqueness) when cooled to temperature T0 after being heated to a temperature T2. Moreover, the thermally sensitive material exhibits minimum light extinction (e.g., it is transparent) when cooled to a temperature T0 after being heated to a temperature T1; T0<-TI<T2.

A recording information storage memory 11 stores recording information which includes a mark dot corresponding to an opaqueness image and a space dot corresponding to a transparent image. Therefore, the mark dot corresponds to a visible image and the space dot corresponds to a non-visible image.

Figure 3A:
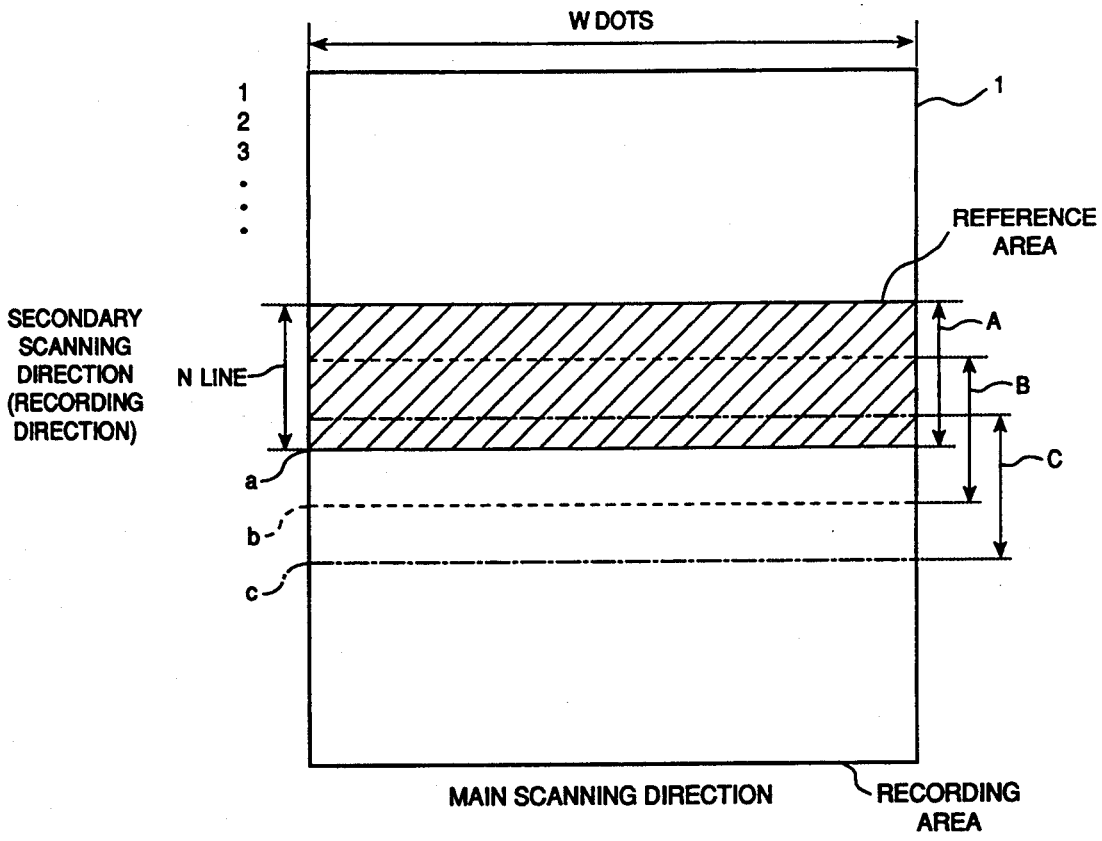
FIGS. 3*a* and 3*b* are an explanatory views showing the relation between the reference area of the dots and the recording area on the medium.
Figure 3B:
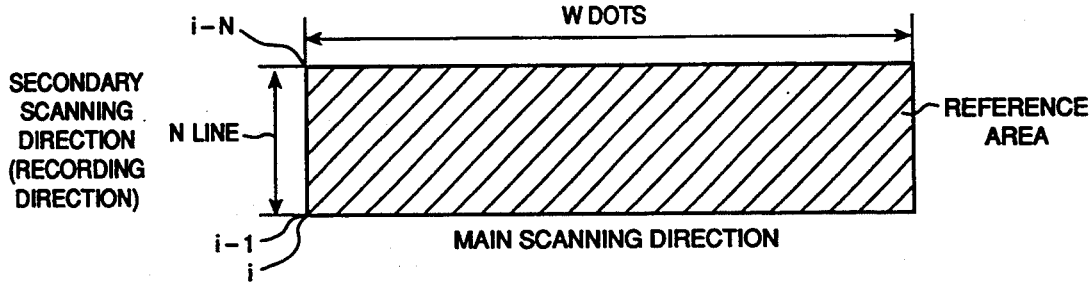

A dot ratio calculator 13 is electrically connected to recording information storage memory 11. Dot ratio calculator 13 calculates the dot ratio in a reference area on the memory map in the recording information storage memory corresponding to a specific area on the medium, as shown in FIG. 3, based on the recording information stored in the recording information storage memory 11. Dot ratio calculator 13 addresses memory 11 to read the dot information for the reference area. Counters in calculator 13 keep a count of marks and spaces within that information, and calculate a ratio between the count values after the whole reference area has been addressed. This is done prior to recording in that reference area.

A memory 14 stores a plurality of weighting tables 15 which have a number of correction values respectively (as shown in FIGS. 4(*b*)-(*f*)). The correction value is utilized to correct an energy to be supplied to thermal elements of the thermal recording system. Also, the correction value is defined in accordance with the condition (a dot pattern of the mark dot and the space dot) of the reference area. The correction value has two elements. The element is selected from the two elements corresponding to the mark dot or the space dot.

A table selector 17 is electrically connected to dot ratio calculator 13 and memory 14. It selects one weighting table $\mathbf{15}_i$ (i=1, 2 . . . n) from memory 14 in response to the dot ratio. A higher dot ratio means higher accumulated heat. Higher ratios therefore use weighting tables that indicate less energy being produced.

A supply energy calculator 19, electrically connected to recording information storage memory 11 and memory 14, calculates the supply energy based on the correction value of the weighting table $\mathbf{15}_i$ selected by table selector 17 and recording information stored in recording information storage memory 11. More specifically, supply energy calculator 19 calculates a recording energy, which records the mark dot, and an erasing energy which erases the mark dot (or records the space dot).

A supply energy controller 21, electrically connected to recording information storage memory 11, controls the supply energy, which is calculated by supply energy calculator 19, based on the recording information stored in recording information storage memory 11. If a current dot is the mark dot, supply energy controller 21 supplies the recording energy calculated by supply energy calculator 19 to recording unit 23. The current dot shows the dot which is just recorded by recording unit 23. On the contrary, if the current dot is the space dot, supply energy controller 21 supplies the erasing energy to recording unit 23.

A recording unit 23, electrically connected to supply energy calculator 19 and supply energy controller 21, records images corresponding to the supply energy based on the control of supply energy controller 21. The recording unit 23 recordes and erases the mark dot on the recording medium 1 on which recording or erasing of the mark dot is to be repeated by supplying the two types of supply energy. In this embodiment, recording unit 23 has a line-type thermal head.

Figure 2A:
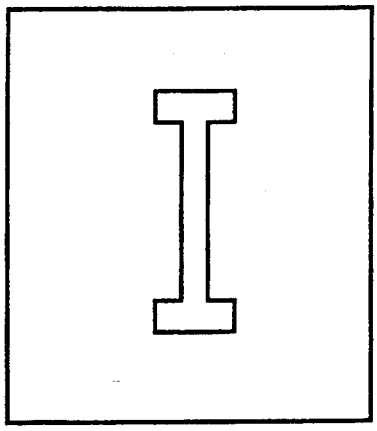
FIGS. 2*a*–2*c* are an explanatory views showing the image erasing and image recording process.
Figure 2B:
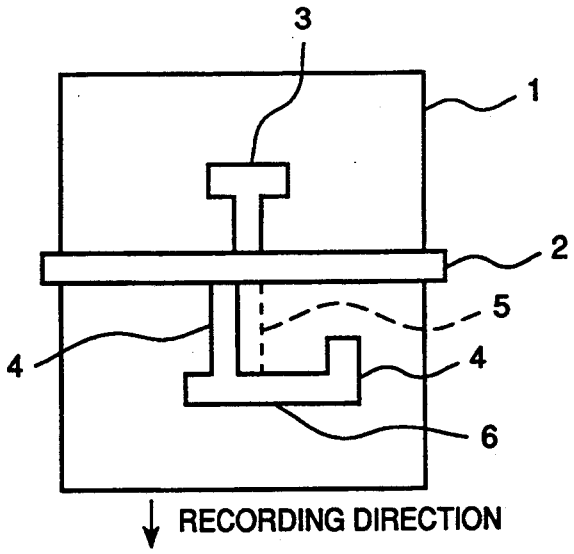
Figure 2C:
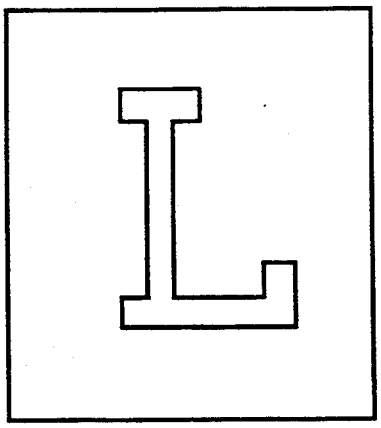

The following is a description of the recording process using the recording system of the present invention, with reference to FIG. 2.

The following is a description, as shown in FIG. 2, of the case when directly overwriting (recording) the letter "L" on the letter "I". Currently, the letter "I", as shown in FIG. 2 (*a*), has been recorded on recording medium 1. FIG. 2 (*b*) is an explanatory view for showing a mid-point of overwriting the letter from "I" to "L". Thermal element 2 are in contact with recording medium 1 and arranged so that the individual elements extend in a perpendicular direction to the recording direction. Also, a sufficient number of thermal elements are provided in the perpendicular direction. A recording portion 3 is the part of the image "I" which was previously recorded. A recording portion 4 is the part of the image "L" which is being newly recorded. A recording portion 5 is an erased part and a recording portion 6 is a re-recorded part of the image "I". When recording a mark dot on recording medium 1, the thermal elements are heated to a temperature T2 at which recording medium 1 rises to the opaque temperature zone. When erasing an area or within a space dot, thermal elements are heated to a temperature T1 at which the recording medium 1 rises to the transparent temperature zone. In this way, the previously recorded letter "I" is erased and the new letter "L" is recorded.

In this embodiment, a specific character of a recording material will be described in the following. The recording material on the recording medium 1 exhibits maximum light extinction when heated above a temperature 90° C. which is the opaque temperature zone and minimum light extinction when heated to temperatures between 70° C. and 80° C. which are the transparent temperature zone. The upper limit of the temperature is limited to a heat resistant temperature of a protective layer coated on the material and the heat resistance of the recording material. For example, the upper limit temperature of the recording medium in this embodiment was about 130° C.

The above description describes the two types of supply energy—the recording energy and the erasing energy—as constant values, respectively. However, it is known that, even if supply energy to the thermal element is constant, the thermal element may not reach a constant temperature because of thermal hysteresis. This is because first the thermal element has an accumulated heat value. Second, the thermal element is influenced by fluctuations of an environmental temperature around the thermal element.

However, it is crucially important to heat the recording material to temperature in the opaque temperature zone, or in the transparent temperature zone, regardless of accumulated heat and the environmental temperature of the thermal element. The present invention defines controlling the supply of energy, so that the temperature of the thermal element can be raised more accurately to the predetermined temperature zones.

The following is a detailed description of the main function which enables the execution of the above more accurate control of supply energy in the recording system of the present invention.

FIG. 3 shows the calculation process of the dot ratio calculated by the dot ratio calculator 13. The rectangular solid line area shown in FIG. 3(*a*) is the recording area on the medium. Inside this, the hatched part of W dots×N lines is the reference area A which is used to calculate the dot ratio. This embodiment shows that the number of dots in the main scanning direction of the reference area A is 446 dots, which is equal to the total number of dots W in the main scanning direction of the recording area. The number of lines N in the secondary scanning direction of the reference area A is adjustable from a value of from 1 to 32 lines. In one example, the line N is set to 24 lines.

Further, the dot ratio calculator 13 updates the reference area in accordance with a relative movement (or position) between the thermal elements 2 and the recording medium 1. For instance, the dot ratio calculator 13 sequentially refers to the reference area A, B and C, in accordance with the recording line being advanced to line a, b and c respectively. Dot calculator 13 calculates the dot ratio based on the number of space dots and mark dots in the reference area. This calculation is conducted according to the following formula.

COUNT VALUE $C_t = F_1 \times W_{D(MARK)} + F_2 \times W_{D(SPACE)}$

DOT RATIO $R_D = C_t/(W \cdot N) + 100$ (%)

$F_1$: Number of mark dots $F_2$: Number of space dots $W_{D(MARK)} = 1$ . . . (mark dot)

$WD(SPACE) = 0.5 < 1 = W_{D(MARK)}$ . . . (space dot)

W: Number of dots in main scanning direction of the reference area

N: Number of lines in secondary scanning direction of the reference area

Table selector 17 selects one of the weighting tables $15_i$ based on the dot ratio calculated from the above-mentioned formula.

The memory 14 stores 5 types of weighting tables. Table selector 17 selects one of the weighting tables according to the calculated dot ratio, in the following manner.

0%≦dot ratio<10%→(select Table 1)

10%≦dot ratio<25%→(select Table 2)

25%≦dot ratio<45%→(select Table 3)

45%≦dot ratio<70%→(select Table 4)

70%≦dot ratio≦100%→(select Table 5)

These tables may be found by experimentation, with the higher numbered tables producing less energy since there is higher accumulated heat. The example tables disclosed herein could also be used.

Next the process for calculating the supply energy will be explained. For instance, recording information stored in the recording information storage memory 11 is illustrated in FIG. 4(*a*). Further, table selector 17 selects a WEIGHTING TABLE 4 shown in FIG. 4(*e*). In the WEIGHTING TABLE 4, hatched segment corresponds to the current dot (i,j) and other segments correspond to peripheral dots to the current dot (i,j). The hatched segment has two basic applying times. An element M:8 of the basic applying time shows a basic recording time for forming the mark dot. The element S:5 is a basic erasing time for forming the space dot. The other segments have a correction value CV, respectively. Each element of the correction value CV shows a correction time for the basic recording time or the basic erasing time. For instance, the correction value $CV_1$ is for the recording information (i−2, j−1). The information corresponding to the correction value $CV_1$ is a space dot, and so supply energy calculator 19 selects an element S:−0.1. On the contrary, if the recording information (i−2, j−1) corresponding to the correction value $CV_1$ is the mark dot, then the supply energy calculator 19 selects an element M:0.5. Thereby, the supply energy calculator 19 calculates an actual recording time (or an actual erasing time) by adding a total of the selected elements to the basic recording time (or basic erasing time).

FIG. 4(*a*) shows an example where recording information (i−2, j−1), (i−2,j+1), (i,j) and (i,j+1) are space dots and recording information (i−2,j), (i−1,j−1),(i−1,j), (i−1,j+1) and (i,j−1) are mark dots. The correction of the basic information will be calculated as exemplified below.

When the recording information is a space dot, supply energy calculator 19 calculates a space dot correction time −0.5, calculated by adding elements S:−0.1, S:−0.1 and S:−0.3 based on recording information (i−2,j−1), (i−2,j+1) and (i,j+1). When the recording information is a mark dot, supply energy calculator 19 calculates a mark dot correction time −3.4, calculated by adding elements M:−0.7, M:−0.6, M:−0.8, M:0.6 and M:0.7 based on recording information (i−2,j), (i−1,j−1), (i−1,j), (i−1,j+1) and (i,j−1).

The supply energy calculator 19 adds the total space dot correction time −0.5 and the total mark dot correction time −3.4 to obtain a total correction time −3.9.

Moreover, since the current dot (i,j) is a space dot, the supply energy calculator 19 adds the correction time −3.9 to the basic erasing time S:5 to obtain the supply energy 1.1. Recording unit 23 records the space dot the current dot based on the supply energy. Moreover, recording unit 23 records all of the space dots and the mark dots based on the supply energy obtained by the supply calculator 19, sequentially.

Figure 5:
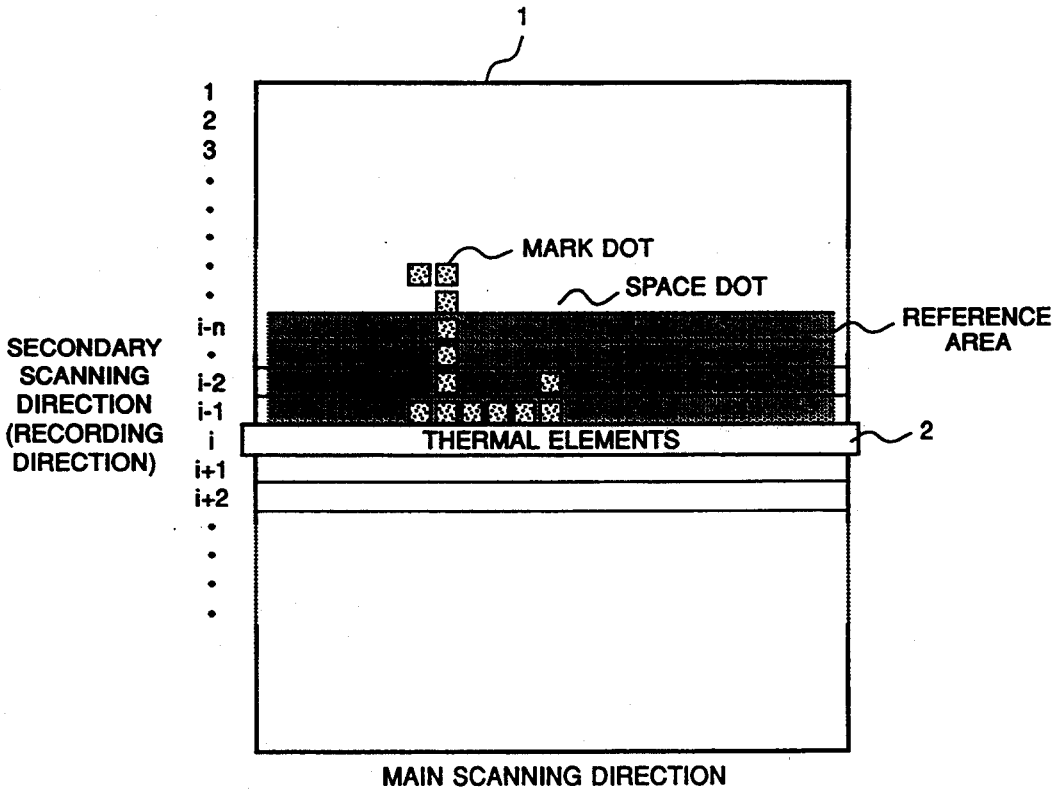
FIG. 5 is an explanatory view useful for explaining the calculation of the dot ratio relative to the thermal elements.

In the above embodiment, weighting value $W_{D(MARK)}$ for the mark dot and weighting value $W_{S(SPACE)}$ for the space dot on the reference area are a constant value. However, the present invention is not limited to such a constant value. For instance, when the thermal elements records images on the line i shown in FIG. 5, a first count value is obtained by multiplying the number of mark dots on the line i−1 by weighting value $W_{D11}$ ($W_{D11}=1.0$). Moreover, a second count value is obtained by multiplying the number of the mark dots on the line i−2 by weighting value WD12 ($W_{D12}=0.9$). The calculation of the n-th count value is continued to the line i-N. The n-th weighting value $W_{D1n}$ is reduced line by line. Then, dot ratio calculator 13 calculates the dot ratio in response to the total of the count value with reference to N lines on the reference area. In the same way, dot ratio calculator 13 calculates the count value concerning the space dots. Further, the dot ratio calculator 13 obtains the dot ratio by adding the count value of mark dot and the count value of the space dot. Table selector 17, in the same way, selects weighting table $15_i$ based on the dot ratio. Then, supply energy calculator 19 calculates the supply energy referring to the selected weighting table $15_i$. Moreover, recording unit 23, in the same way, records images based on the supply energy.

Other embodiments of the invention will be apparent to the skilled in the art from consideration of the specification and practice of the invention disclosed herein. It is intended that the specification and examples be considered as exemplary only, with a true scope and spirit of the invention being indicated by the following claims.

What is claimed is:

1. A method for changing a light extinction of a material coated on a medium, the material exhibiting a first light extinction amount at a first threshold temperature and exhibiting a second light extinction amount at a second threshold temperature which is higher than the first threshold temperature, the method utilizing a thermal head having a plurality of thermal elements which heat the material based on an applied energy, comprising the steps of:

storing a plurality of weighting tables, each including a correction value which is used to correct the energy to be supplied to the thermal elements;

calculating a dot ratio concerning a ratio of the number of dots corresponding to the second light extinction amount to a whole number of dots in a reference area on the medium;

selecting one of the weighting tables based on the dot ratio; and controlling the energy applied to the thermal elements based on the correction value of the selected weighting table.

2. The method according to claim 1, wherein the calculating step includes the step of:

calculating the dot ratio concerning a ratio of a value which is calculated by multiplying the number of dots corresponding to the second light extinction into a predetermined weighting value, to the whole number of dots in the reference area.

* * * * *